United States Patent [19]

Holz

[11] 3,944,109

[45] Mar. 16, 1976

[54] COMBINATION SERVING TRAY WITH REMOVABLE INSERT FOR SERVING MEANS

[75] Inventor: Heinz Holz, Velber, Hannover, Germany

[73] Assignee: FKF Berlin Fleischwaren und Konservenfabrik, Schulz & Berndt GmbH & Co. KG, Berlin, Germany

[22] Filed: Nov. 9, 1973

[21] Appl. No.: 414,604

[30] Foreign Application Priority Data

Nov. 9, 1972 Germany ..... 2255424

[52] U.S. Cl. ..... 220/20; D7/37; D7/71; 206/72; 220/23.8; 220/23.83; 229/2.5 R

[51] Int. Cl.[2] ..... B65D 25/10; B65D 3/24

[58] Field of Search ..... 220/23.4, 23.8, 23.83, 220/23.86, 20; 229/2.5; 206/72; D7/37, 38, 70, 71

[56] References Cited

UNITED STATES PATENTS

| | | | |
|---|---|---|---|
| 2,709,904 | 6/1955 | Boughton | 220/20 |
| 2,851,154 | 9/1958 | Dingeldein | 206/72 |
| 3,103,303 | 9/1963 | Lynchey | 206/72 |
| 3,113,710 | 12/1963 | Meagher | 220/23.8 |
| 3,305,126 | 2/1967 | Cease | 220/23.83 |
| 3,542,280 | 11/1970 | Crabtree | 229/15 |
| 3,643,812 | 2/1972 | Mander | 206/72 |

*Primary Examiner*—George E. Lowrance
*Attorney, Agent, or Firm*—Nolte & Nolte

[57] ABSTRACT

A combination serving tray containing a removable insert for the storage of containers for the preparation of cold and hot means is disclosed, the insert and tray having interfitting parts, the insert having ledge areas for lifting the same for use as a tray as well as an insert.

3 Claims, 3 Drawing Figures

COMBINATION SERVING TRAY WITH REMOVABLE INSERT FOR SERVING MEANS

This invention is concerned with serving units of the general kind described in co-pending application Ser. No. 271,588 filed July 13, 1972.

This invention minimizes the amount of effort required when preparing cold and hot meals from a combination serving tray containing a removable insert formed with a plurality of openings for the storage of containers; it also simplifies the handling of containers which require heating prior to the consumption of their contents.

Figure 1:
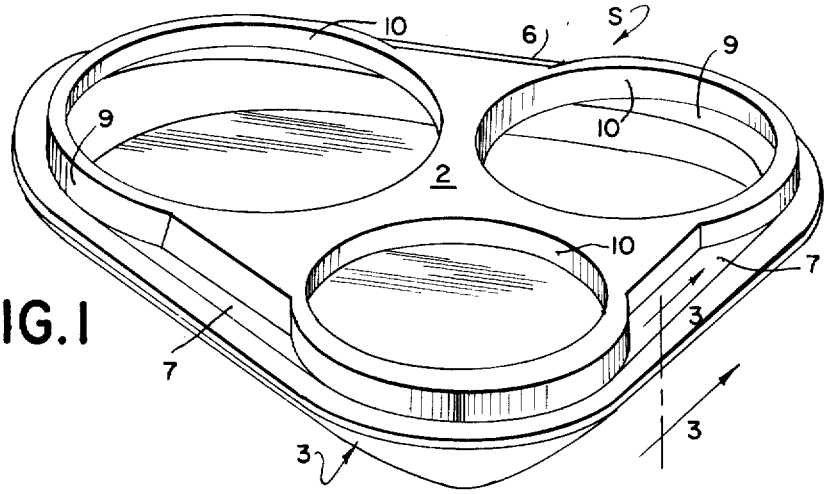
FIG. 1 is a top perspective view of the serving tray with the attached insert for the storage of containers.
Figure 2:
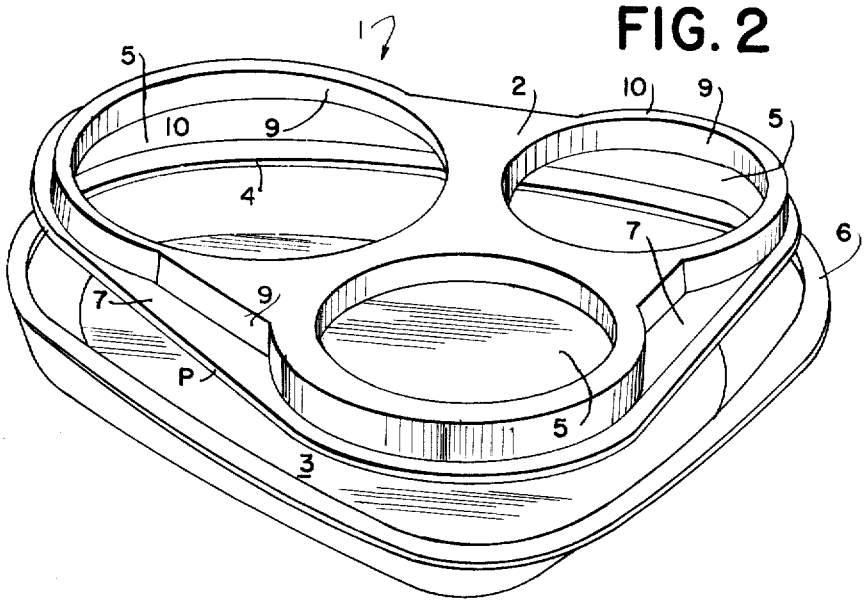
FIG. 2 is an exploded top perspective view of the tray of FIG. 1.
Figure 3:
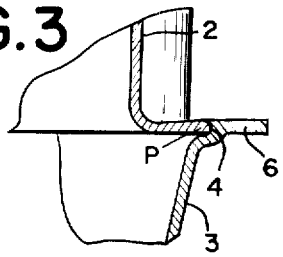
FIG. 3 is a sectional view broken away and taken along the line 3—3 of FIG. 1.

The combination serving tray is a further development of the invention described in co-pending application Ser. No. 271,558, having as one of its objectives an esthetically pleasing and particularly compact combination of a serving tray and a removable insert, suitable for the serving of meals intended particularly for mass consumption.

The invention is a modification of the invention described in said application; referring in particular to reference numeral 2 of said application, the fact that the insert for the storage of containers in conjunction with these containers forms a serving tray of its own, and that the remainder of the serving tray can be discarded, constitutes the gist of this invention.

Provision is made for insert 2 to be attached to service tray 3, and to be easily removed from service tray 3, if desired. An attachment of this type can be formed, for example, by making provision for a recess or indentation 4 covering the circumference of the upper portion of the rim of serving tray 3 and providing a corresponding fitting protrusion P along the circumference of insert 2, whereby insert 2 can be snugly inserted into serving tray 3 by applying a slight pressure on insert 2; insert 2 is formed with a plurality of holes 5 for the insertion of cans.

Other variations of such an easily removable insert are possible, such as making provision for a recess or indentation in insert 2, and providing for a corresponding protrusion along the circumference of service tray 3.

In any event, the serving tray 3 is formed with a circumferential ledge for lifting the combination S or the tray 3 alone. The insert 2 is also formed with lifting flats 7 extending outwardly from indented portions of wall 9 and between raised container receiving holes 5 formed in top 8 of the insert supported by wall 9 providing extra vertical space for containers. Inner skirts 10 form depending surfaces of revolutions about the holes 5 for strengthening the top 8.

Several cans can be inserted very easily into the combination service tray. The whole package may be wrapped in transparent foil, and the consumer, upon wishing to serve a meal, need only remove the insert from the serving tray and heat the cans in either hot water or in a suitable domestic oven. Furthermore, the consumer can, if he desires, also prepare an additional dish of basic food, such as cooked potatoes, noodles or rice, and serve the resulting meal either on a separate plate or on said serving tray. This latter possibility is particularly attractive where it is more economical to use disposable plates, as for example in some diners or restaurants, or whereever a large number of people have to be served a warm meal within a short time span.

The several parts of the combination are made of biodegradable material, so that the disposal of both the serving tray and the insert do not present a problem in garbage disposal.

It was found that pressed cardboard is a suitable material from which to manufacture insert 2 especially since it is slightly deformable to temporarily decrease the effective circumference of its periphery for inserting and rmoving the protrusion thereof into and out of the recess in the tray; the insert can be impregnated with a suitable resin, such as, for example, phenolic resin, or else can be similarly rendered tempeature- and water-resistant by the application of suitable paint. The serving tray can be made of suitable plastic material, the composition of which does not cause any problems in garbage disposal, i.e., no hydracid is formed when burning the material, or alternately, the material is made to be easily absorbed by naturally occurring bacteria in the earth.

It should be understood, of course, that the foregoing disclosure relates only to a preferred embodiment of the invention, and that it is intended to cover all changes and modifications of the example of the invention herein chosen for the purpose of the disclosure which do not constitute departures from the spirit and scope of the invention set forth in the appended claims.

What is claimed is:

1. A serving unit comprising a tray having a continuous, planar base, said base constituting means for supporting containers of food, sides upstanding from said base, a flat ledge projecting outwardly from and extending circumferentially around the upper edges of the sides, and providing an inner depression at the junction of the upper edges of said sides and said ledge a removable insert having a flat marginal portion circumferentially substantially co-dimensional with said inner depression, said ledge constituting means for supporting said insert on the inner depression of said ledge and when so supported providing with said ledge means for lifting said tray and insert together, said insert having a raised portion inwardly of said marginal portion and disposed above the marginal portion, said raised portion being formed with a plurality of openings therethrough, at least one of said openings being of different dimensions than the others, said openings constituting means for receiving containers of food to be supported upon the base of the tray, the marginal edges of said openings being constituted as means inhibiting movement of containers inserted in said openings across the base of the tray, said depression of said ledge and said marginal portion being formed with recess and projecting means said recess and projecting means constituting horizontal interfitting means between said tray and insert, said insert being deformable for moving said marginal portion into and out of interfitting engagement with said ledge for releasably securing said tray and insert to one another, said raised portion of said insert extending upwardly from said marginal portion at selected locations spaced sufficiently inwardly of the projecting means thereof to constitute said marginal portion at such positions as flat gripping means for lifting said insert by a user thereof and for facilitating its manipulation separately from said tray, said horizontal interfitting means constituting the sole means for releasing and securing said tray and insert to one another.

2. A unit as claimed in claim 1, wherein the marginal edges of said openings of the insert are provided with downwadly depending sleeves.

3. A unit as claimed in claim 2, wherein said openings are of circular outline and said sleeves are generally cylindrical.

* * * * *